US006148448A

United States Patent [19]

Urso

[11] Patent Number: 6,148,448

[45] Date of Patent: Nov. 21, 2000

[54] PORTABLE SQUAT SUPPORT

[76] Inventor: Charles L. Urso, 54 Marivista Ave., P.O. Box 541136, Waltham, Mass. 02454-1136

[21] Appl. No.: 09/334,338

[22] Filed: Jun. 16, 1999

Related U.S. Application Data

[60] Provisional application No. 60/118,976, Feb. 8, 1999.

[51] Int. Cl.[7] ..... E03D 11/00

[52] U.S. Cl. ..... 4/254; 4/661; 297/423.44

[58] Field of Search ..... 4/254, 661; 135/65, 135/75, 67; 297/423.12, 423.25, 423.44, 423.45, 423.38

[56] References Cited

U.S. PATENT DOCUMENTS

| | | | |
|---|---|---|---|
| 245,639 | 8/1881 | Lay | 4/254 |
| 1,067,767 | 7/1913 | Simonson | 4/254 |
| 1,674,116 | 6/1928 | Lord . | |
| 2,083,605 | 6/1937 | Jertberg | 297/423.44 |
| 3,090,051 | 5/1963 | Oakland | 4/254 |
| 3,619,820 | 11/1971 | Cain et al. . | |
| 4,466,140 | 8/1984 | Sakamoto | 4/254 |
| 5,028,024 | 7/1991 | Welles . | |
| 5,094,131 | 3/1992 | Sorensen et al. . | |
| 5,509,152 | 4/1996 | Kippes | 5/81.1 |
| 5,553,334 | 9/1996 | Hillman | 4/254 |
| 5,725,280 | 3/1998 | Kushnir | 297/423.44 |
| 5,809,583 | 9/1998 | Pucciani . | |

*Primary Examiner*—David J. Walczak

[57] ABSTRACT

A portable squat support (10) for supporting a user in an advantaged posture to facilitate defecation while on a toilet. Included is an elongate, cushioned, horizontal upper body support (22) and upright members (12) for supporting the body support in front of the toilet so that the user's forward leaning upper body is supported on the body support. A footrest (24) is connected to the upright members and positioned below the body support for supporting the user's legs in an elevated bent position. A footrest height-adjusted for vertically adjusting the footrest is included. A height scale (36A) having graduated marks that represent heights of potential users is displayed on the squat support. The marks are arranged cooperatively with the height-adjuster for guiding a user to vertically adjust the footrest to a predetermined position that is particularly advantageous for the user according to the user's height. A device for adjusting the footrest at selective pitch angles is also provided. Among embodiments disclosed, are embodiments (50, 60, 70, 100) having respective drivers (47, 61, 90, 95) for raising and lowering the footrest with the user's legs supported on the footrest.

18 Claims, 4 Drawing Sheets

PORTABLE SQUAT SUPPORT

CROSS-REFERENCE TO RELATED APPLICATIONS

This application is entitled to the benefit of Provisional patent application Ser. No. 60/118,976, filed Feb. 8, 1999.

BACKGROUND—FIELD OF INVENTION

This invention relates to devices for supporting a user on a toilet, and more particularly to devices that support the user in a squat position for defecation.

BACKGROUND—GENERAL

Humans evolved to defecate from a squat position, not a sitting position. In a squat position, the anal canal AC (FIG. 11) is vertically aligned with the rectum R so that passage resistance is minimized and the act of defecation is practically effortless. Evacuation is more complete, efficient, and timely so that stool transit time is reduced. That reduces the time that stool toxins are in contact with the bowel wall, thereby reducing the risk for colon and rectal cancer. But, with advent of modern toilets, squatting was abandoned and sitting on toilet seats has become conventional in developed countries.

In the sitting position, however, pelvic musculature causes the anal canal AC (FIG. 12) to bend against the rectum R. The bend causes substantial resistance to the passage of bowel contents. Sitting, therefore, is unnatural for defecation and people often have to strain in order to defecate when sitting on toilet seats. Bowel movements may be incomplete and successive movements can be difficult, irregular, and painful as stool hardens. Hence, feeling bloated, uncomfortable, and being constipated is a common problem. The increased stool transit time increases the risk for colon and rectal cancer as toxins common in the stool are in contact with the bowel wall for longer periods. Rates of colon and rectal cancer are higher in developed countries; lower in undeveloped countries where squatting to defecate is still practiced.

Another health problem caused by the conventional sitting position on toilet seats is hemorrhoids. As a person sits upright, upper body weight causes the toilet seat to create a compression ring around the buttocks. Normal blood flow out of the anal and rectal veins is restricted by the compression, thereby increasing blood pressure within the veins. As the pressure builds, the veins may swell or balloon out. Straining during bowel movements, caused by the sitting position, also contributes to excessive pressure in the anal and rectal veins. After repeated episodes, the veins are permanently damaged and typically result in the formation of internal and/or external hemorrhoids.

Attempts at preventing the above-described health disorders have resulted in toilet seats and/or foot supports disclosed in U.S. Pat. Nos. that include those of Pucciani, 5,809,583, Wells, 5,028,024, and Lord,1,674,116. Other devices intended to support children or disabled adults on toilets, but not in a squat posture, include those disclosed in the U.S. Pat. Nos. of Cain, et al., 3,619,820 and Oakland, 3,090,051. None of prior art devices, however, provide an adequate preventive solution for the health disorders resulting from defecation in a sitting position. A major shortcoming of the prior art devices is that they don't simultaneously support the user's upper body and lower body relative to each other such that a consistent optimal squat angle occurs between torso and femurs. Another shortcoming of the prior art devices is that they don't relieve upper body weight pressure from the toilet seat while supporting the user is in a squat posture. The prior art devices also lack means for guiding a user to adjust a foot support to an advantageous position according to the user's height. Still another deficiency of the prior art is the lack of a low cost means for height-adjusting a foot support by a method that avoids having to stoop down to the foot support.

OBJECTS AND ADVANTAGES OF THE INVENTION

The present invention is a modern solution that is substantially advantaged over the prior art by fully supporting the user in a physiologically optimum position for defecation. It also overcomes the inconveniences and discomfort of unsupported squat posture. Accordingly, objects and advantages are:

A. to provide a portable device that acts in concert with any conventional toilet to fully support a user in an optimal squat posture for:
   (a) facilitating defecation to avoid straining and the potential for damage to the lower bowel.
   (b) avoiding constipation and related conditions.
   (c) reducing the risk of hemorrhoids.
   (d) reducing stool transit time to reduce the risks of other disorders in the lower digestive track, including the serious disorders resulting from stool toxins in the bowel.

B. to provide a device for achieving the above objectives by including means for positioning a user of any height at an optimum squat angle of approximately 30 degrees between torso and femurs.

C. to provide a device for achieving the above objectives wherein the user's upper body weight is supported to relieve the ring of compression caused by pressure from toilet seats against the buttocks of the user, thereby reducing the risk of hemorrhoids.

D. to provide a portable device for achieving the above objectives and is maintenance free.

E. to provide a portable device for achieving the above objectives and is compact, light, and takes up very little space.

F. to provide a portable device for achieving the above objectives and has a benignant appearance that is advantages for commercialization.

G. to provide a portable device for achieving the above objectives and can be made of metal tubing and molded plastic such that it can be packaged disassembled to reduce the size and volume of packaging.

SUMMARY

The present invention provides a portable device for supporting a user in an advantaged posture to facilitate defecation while on a toilet. Included is an elongate, cushioned, horizontal upper body support and upright means for supporting the body support in front of the toilet such that the user's forward leaning upper body is supported on the body support. A footrest is connected to the upright means and positioned below the body support for supporting the user's legs in an elevated bent position. The upper body support is positioned forward of an upright member comprising the upright means so that the upper body support is closer to a user than the upright member. An elongate upstanding footrest height-adjuster is slidably supported by the upright member and is connected to the footrest so that the footrest is height-adjustable. The footrest height-adjuster has an upper end portion positioned substantially above the footrest for adjusting the height of the footrest from a user-convenient position. A height scale having graduated marks, including numerals, that represent heights of potential users is displayed on the device. The marks are arranged cooperatively with the footrest height-adjuster for guiding a user to vertically adjust the footrest to a predetermined position that is most advantageous for the user according to the user's height. Means for adjusting the footrest at selective pitch angles is also provided. The combination, in concert with any conventional toilet, comfortably supports the user in the advantaged posture. Among preferred embodiments disclosed, are embodiments having drivers for raising and lowering the footrest while the user's legs are supported thereon.

BRIEF DESCRIPTION OF THE DRAWINGS

The accompanying drawings in combination with the description herewith, illustrate features and advantages of the invention. Like reference numerals in different views refer to the same parts. The drawings are intended to illustrate principles of the invention and are not necessarily to scale.

DESCRIPTION OF PREFERRED EMBODIMENTS

Figure 1:
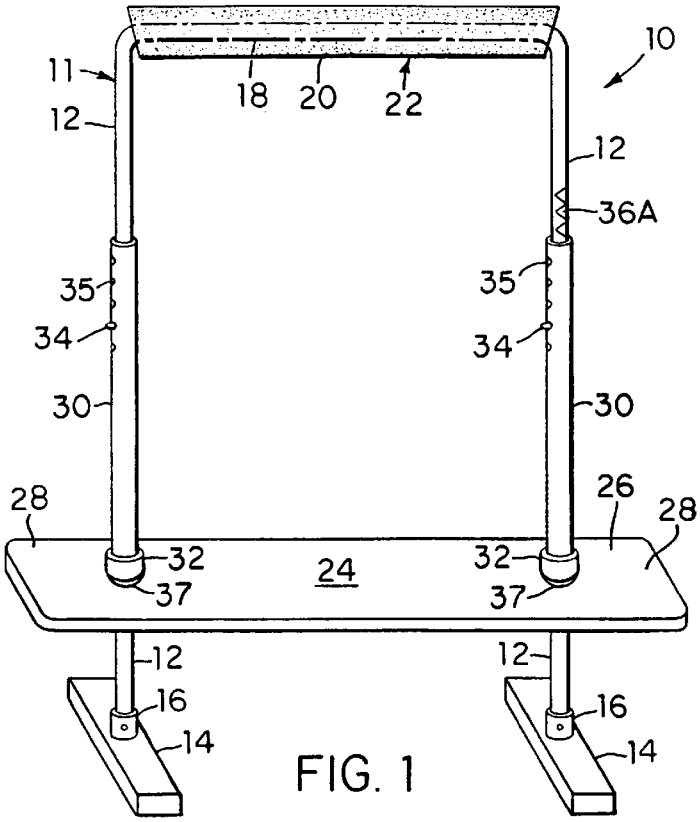
FIG. 1 is a front perspective view of a preferred portable squat support.
Figure 2:
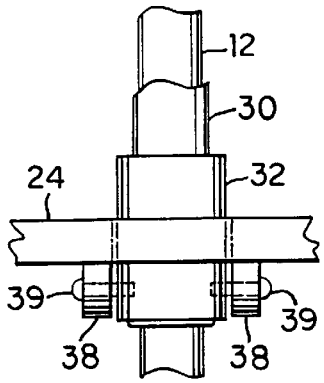
FIG. 2 is an enlarged fragmental front view showing means for pivotally supporting a footrest of the squat support of FIG. 1.

FIGS. 1–10 show preferred embodiments of the invention and illustrate principles thereof. Beginning with FIGS. 1 and 2, a preferred portable squat support 10 is shown. Included is a U-shaped aluminum tube 11, of circular cross-section, having parallel legs that form a pair of spaced elongate upright members 12 approximately eighteen inches apart. Each of two spaced apart plastic bases 14 includes an integrally molded sleeve 16 that receives and holds a lower end portion of a respective upright member 12 fixed therein by a set screw. The pair of molded bases 14 thereby support the members 12 in an upstanding position. Tube 11 has a ⅞ inch outside diameter.

An elongate horizontal cross-member 18, of tube 11, is transversely connected to respective upper end portions of upright members 12 and spans therebetween. A tubular soft foam cushion 20 surrounds the length of cross-member 18. A slit (not shown) along an underside of cushion 20 enables removal and replacement. Cushion 20 and cross-member 18 form an elongate horizontal member or upper body support 22 for supporting the upper body of a user. Support 22 also serves as a convenient carrying handle for portable squat support 10. The distance from the bottom of bases 14 to the top of support 22 is approximately thirty-two inches.

An elongate rectangular plastic molded footrest 24 is movably connected to upright members 12 for supporting a user's legs in an elevated position. The user's feet normally rest on an upper surface 26 of footrest 24 wherein a longitudinal front edge thereof extends further from members 12 than a longitudinal back edge. The long dimension of rectangular surface 26 is parallel to support 22.

Footrest 24 spans between upright members 12 a sufficient width such that the user's feet may be between upright members 12 when resting on footrest 24. Outer end portions 28 of footrest 24 extend in opposite directions at least five inches laterally of upright members 12 so that members 12 may be between the user's feet when resting on footrest 24. Hence, the user can choose to place his or her feet laterally of members 12 or therebetween. When a user's feet are between members 12, the user's knees may also be between members 12 or positioned laterally thereof.

Squat support 10 includes means for adjusting the height of footrest 24. The footrest adjusting means includes a pair of elongate slider members 30 slidably mounted to upright members 12, respectively. Each slider member 30 is an aluminum tube surrounding and having a common axis with a respective upright member 12. A lower end portion of each slider member 30 is connected to footrest 24 so that members 30 and footrest 24 are vertically movable along upright members 12.

Each slider member 30 includes an upper end portion having locking means for locking onto upright members 12 at selective height levels for adjusting the height of footrest 24. The locking means comprises conventional spring button locks 34 mounted in members 12 for selectively entering regularly spaced apertures 35 arranged in vertical columns along upper end portions of slider members 30. Hence, a user can slidably adjust and lock footrest 24 at preferred heights without having to stoop down to footrest 24.

A user height scale 36A, printed on an upright member 12, includes numbered color-coded triangle-shaped marks that stand for heights of potential users. A user can vertically adjust footrest 24 to a predetermined position most advantageous for him or her by moving the top of slider member 30 to a scale mark that most closely represents the user's height.

Footrest 24 is pivotally supported for supporting user feet at adjustable angles. The pivotal support means comprises a pair of sleeves 32 that receive respective lower end portions of members 30 tightly fitted therein. A flared lower end of each slider member 30 prevents detachment from a respective sleeve 32. Each sleeve 32 is within a respective oval or elliptical-shaped aperture 37 through footrest 24. A major axis of each elliptical aperture 37 is orthogonal to a longitudinal axis of footrest 24. A minor axis of each elliptical aperture 37 is approximately a quarter inch larger than the outside diameter of a sleeve 32. Each sleeve 32 is positioned between a pair of lugs 38 (FIG. 2), integrally molded on an underside of footrest 24, adjacent each aperture 37. Pins 39, passing through aligned pinholes in respective lugs 38 and in respective lateral sides of each sleeve 32, pivotally support footrest 24. The pivotal axis is parallel to the longitudinal axis of footrest 24. A user's resting feet can be level or slightly angled up or down, as preferred by the user, by pivotally tilting footrest 24.

A user sitting on a toilet seat can place squat support 10 in front of the toilet and rest his or her feet on footrest 24. The forward leaning upper body of the user can rest on support 22 by any one of several methods. By one method, the user's arms can rest folded on support 22 wherein the user's chin or forehead can rest on his or her folded arms. By another method, the user's hands can hold support 22 and the user's chin or forehead can rest directly on support 22. Yet another method includes placing squat support 10 very close to the user's torso and resting the user's chest on support 22 wherein the user's arms may be folded or with hands on support 22. Any of the described methods will position the user in a supported squat posture advantaged to facilitate defecation. The supported squat posture also helps to prevent hemorrhoids and other bodily harm by obviating strain during defecation. Additionally, upper body weight pressure on the buttocks is substantially reduced thereby reducing the venous pressure that forms and exacerbates hemorrhoids. Along with improved bowel function, the user is also supported for physical comfort.

Figure 3:
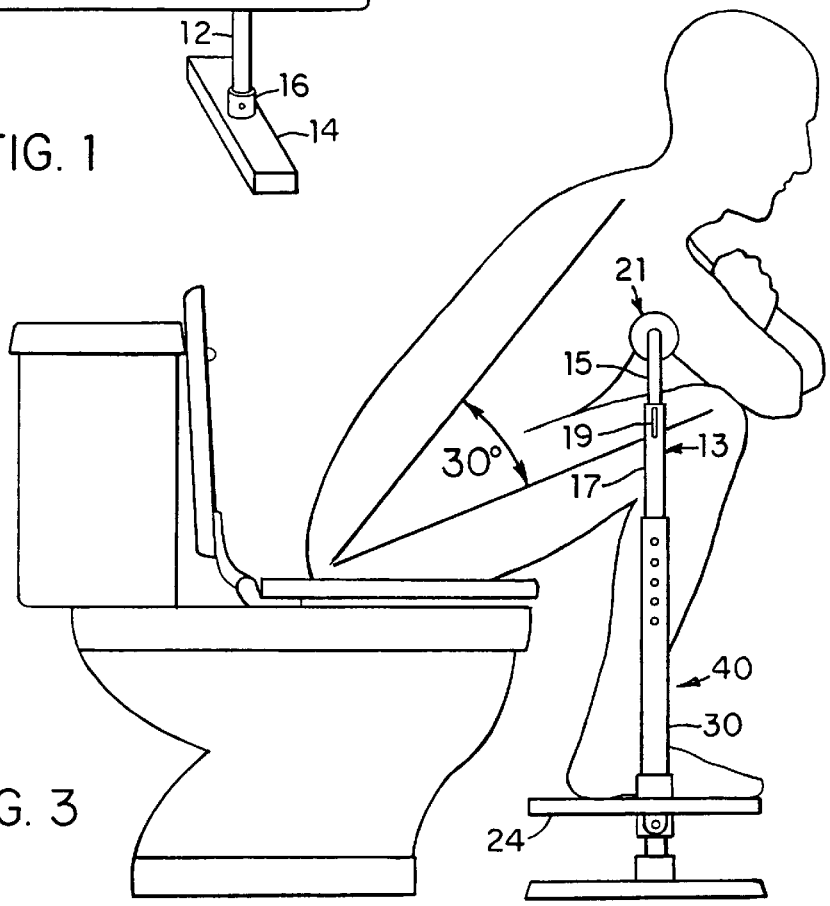
FIG. 3 is a side view of another preferred portable squat support.

FIG. 3 shows another preferred portable squat support 40 that is similar to squat support 10 except for the differences described as follows. Each of two identical upright members 13 (only one is shown) is comprised of telescoping aluminum tubes 15 and 17; one within the other. A winged lock screw 19, mated to a threaded bore in tube 17, can be tightened to lock tube 15 in selective height adjusted positions. An elongate horizontal upper body support 21, similar to support 22, is connected between upper end portions of upright members 13, and is therefore height adjustable.

Figure 4:
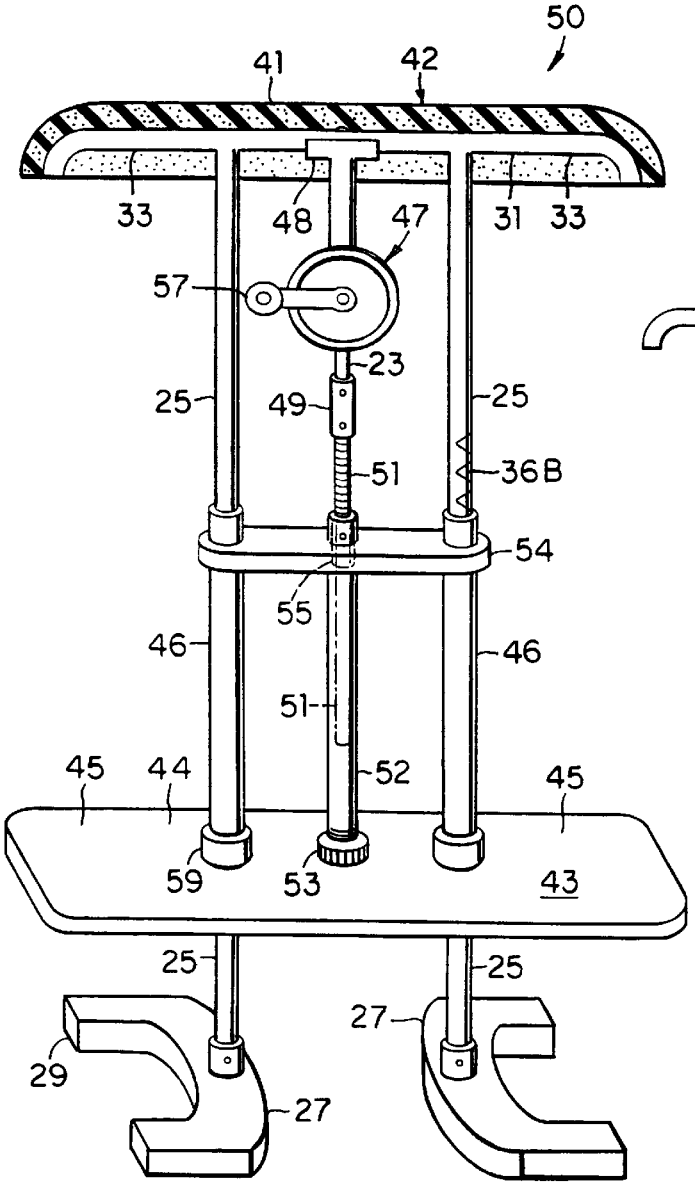
FIG. 4 is a front perspective view of another preferred portable squat support.

FIG. 4 shows another preferred portable squat support 50. Included in squat support 50 is a parallel pair of spaced elongate upright members 25, each being comprised of an aluminum tube of circular cross-section. A pair of spaced plastic molded bases 27 are fixedly connected to lower end portions of upright members 25, respectively, for supporting members 25 in an upstanding position. The connecting means is similar to that described for connecting bases 14 to members 12 of squat support 10. Each base 27, however, is U-shaped and has legs 29 extending in directions opposite to those of the opposite base 27.

An aluminum tube, forming a horizontal cross-member 31, is welded transversely to upper end portions of upright members 25 and spans therebetween. Lateral end portions 33, of cross-member 31, extend in opposite directions laterally of members 25 and have down-turned tip portions. An elongate molded soft foam cushion 41 surrounds the length of cross-member 31, wherein a slit along an underside of cushion 41 enables removal and replacement. Cushion 41 and cross-member 31 form an elongate horizontal member or upper body support 42. The distance from the bottom of bases 27 to the top of support 42 is approximately thirty-two inches.

An elongate rectangular plastic molded footrest 43 is movably connected to upright members 25 for supporting a user's legs in an elevated position. User's feet normally rest on an upper surface 44 of footrest 43. Outer end portions 45 of footrest 43 extend in opposite directions laterally of the upright members 25 approximately eight inches so that the upright members 25 are between the user's feet when resting on footrest 43.

Footrest adjusting means includes a pair of elongate slider members 46 slidably mounted to upright members 25, respectively. Each slider member 46 is a tube surrounding and having a common axis with a respective upright member 25. A lower end portion of each slider member 46 is fixedly connected to footrest 43 so that members 46 and footrest 43 are vertically movable along upright members 25. The connecting means includes sleeves 59, integrally molded with footrest 43, that receive respective lower end portions of members 46 tightly therein. Flared lower ends (not shown) of members 46, beneath footrest 43, prevent detachment.

A reversible rotary driver 47, comprising a conventional hand drill driver, is provided with a saddle-shaped mount 48 that interfaces with a central portion of cross-member 31. A screw that passes through cross-member 31 and into mount 48 holds driver 47 between, and axially parallel to, upright members 25. Driver 47 includes a hand crank 57, drivingly connected to bevel gears, for drivingly rotating a drive shaft 23.

A connector 49 fixedly connects drive shaft 23, of driver 47, to a threaded rod 51. A tube 52, coaxially receiving rod 51, includes an externally threaded lower end portion that passes through an aperture in footrest 43. Tube 52 is fixed to footrest 43 by an upper nut 53 and a lower nut (not shown) on the underside of footrest 43.

Within an upper end portion of tube 52 is an internally threaded sleeve 55 surrounding and threadedly mated to rod 51. A setscrew or tack welding fixedly secures sleeve 55 in tube 52. A plastic molded brace 54 includes three apertures for receiving upper end portions of slide members 46 and tube 52 to stabilize the system. As arranged, clockwise rotation of hand crank 57, of driver 47, rotates rod 51 thereby raising footrest 43 wherein counterclockwise rotation of hand crank 57 lowers footrest 43.

A user height scale 36B, printed on a member 25, is used in the same manner as described for scale 36A of squat support 10. In this case, the top of a slider member 46 can be moved to a selected scale mark.

Figure 5:
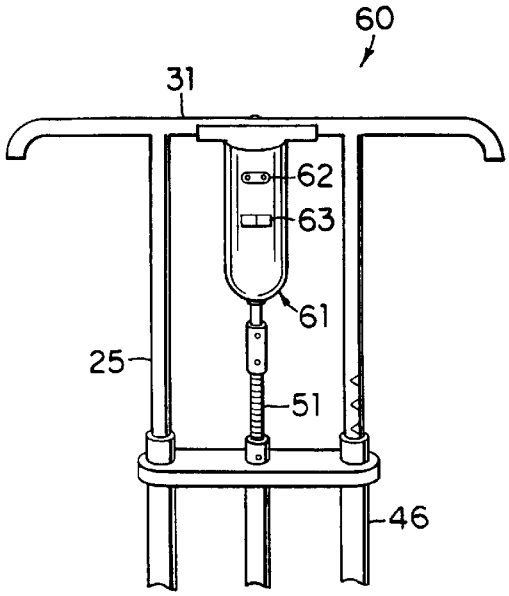
FIG. 5 is a fragmental front perspective view of another preferred portable squat support.

As shown in FIG. 5, another preferred portable squat support 60 is similar to squat support 50, but includes a conventional cordless electric rotary driver 61, instead of a rotary hand driver. Driver 61 is mounted to cross-member 31, and is drivingly connected to threaded rod 51, like driver 47 of squat support 50. Power is derived from a rechargeable power tool battery (not shown) detachably received in a conventional battery holder extending from a back side (not shown) of driver 61. As is common with cordless power tools, the battery can be removed for recharging when necessary. Driver 61 is of the reversible type used in power drills. Pushing one end of a momentary pivotal switch 62 actuates driver rotation in one direction for raising the footrest. Pushing an opposite end of switch 62 actuates driver rotation in an opposite direction for lowering the footrest. Rotational speed is controlled with a speed selector switch 63. Squat support 60 is otherwise the same as squat support 50 without cushion 41.

Figure 6:
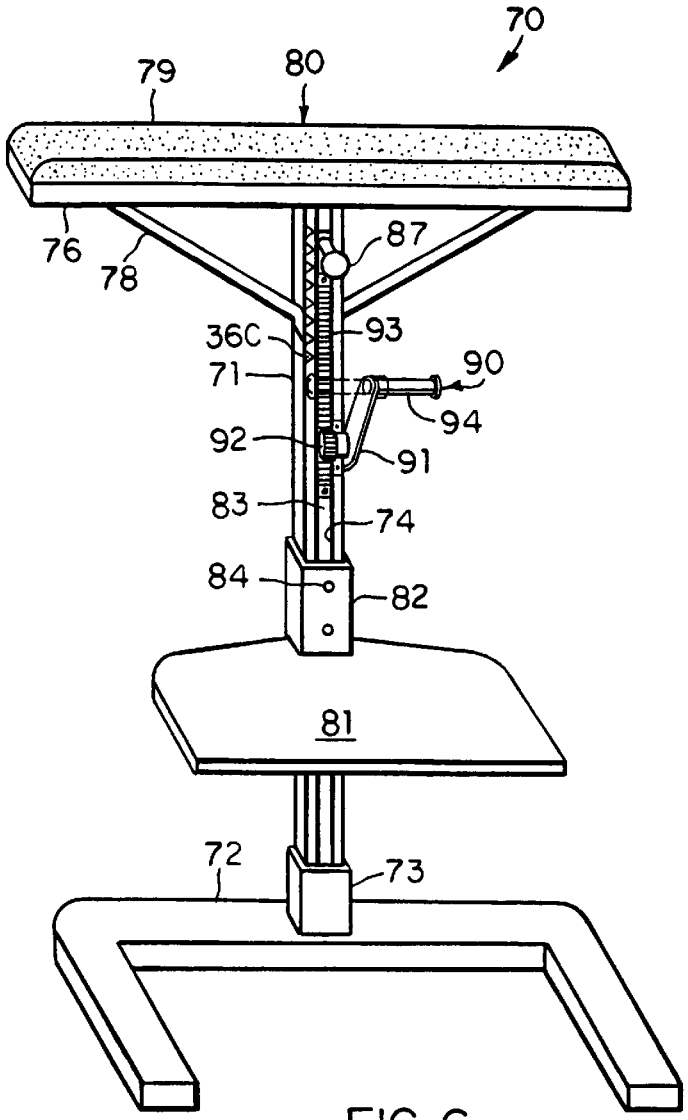
FIG. 6 is a front perspective view of another preferred portable squat support.
Figure 7:
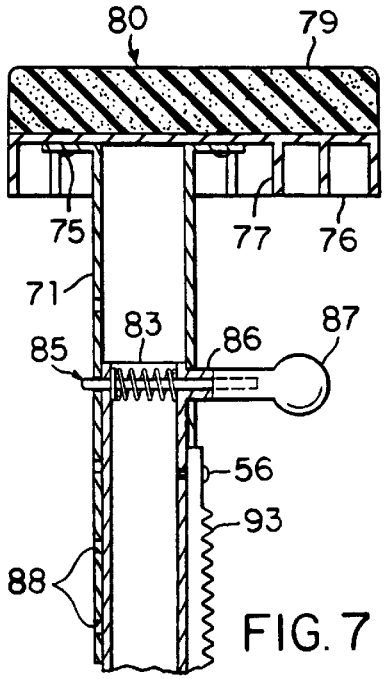
FIG. 7 is an enlarged fragmental side sectional view of an upper portion of the squat support of FIG. 6.

FIGS. 6 and 7 show another preferred squat support 70 having an upright member 71 supported upstanding by a U-shaped plastic molded base 72. A sleeve 73, integrally molded with base 72, receives a lower end portion of member 71 tightly therein. Upright member 71 is a first aluminum tube, of square cross-section, having a longitudinal slot 74 through a front wall of the tube. An upper end of member 71 (FIG. 7) is flanged and riveted, with rivets 75, to an underside of an elongate plastic molded horizontal cross-member 76. The structure of cross-member 76 is that of a shallow rectangular box open at the bottom. Internal longitudinal ribs 77 add rigidity. Shelf brackets or angled braces 78 (FIG. 6), attached by conventional fastening means, provide additional support. A soft elongate cushion 79 is attached to the top of member 76 with an adhesive. Cushion 79 and cross-member 76 form an elongate upper body support 80 connected transversely to an upper end portion of upright member 71. The distance from the bottom of base 72 to the top of cushion 79 is approximately thirty-two inches.

A plastic molded footrest 81 is movably connected to upright member 71. The connecting means includes a sleeve 82 integrally molded with footrest 81. Sleeve 82 surrounds upright member 71wherein footrest 81 substantially surrounds sleeve 82 and extends laterally and frontally therefrom as a broad-faced horizontal plate.

An elongate slider member 83 (best seen in FIG. 7), shorter than upright member 71, is slidably supported within member 71. Slider member 83 comprises a second aluminum tube of smaller diameter than member 71 and is of square cross-section. A lower end portion of slider member 83 is connected to footrest 81 so that member 83 and footrest 81are vertically movable along upright member 71. The connecting means comprises screws 84 (FIG. 6) passing through sleeve 82, and through slot 74, and into the lower end portion of member 83. Washers (not shown) around screws 84, between sleeve 82 and member 83, provide spacing therebetween.

Slider member 83 also includes an upper end portion having locking means for locking onto upright member 71 at selective height levels. The locking means includes a spring-loaded lock bolt 85 (FIG. 7) supported by a bushing 86 positioned within slot 74 and welded to member 83. A knob 87, fixed to lock bolt 85, enables operation of the lock and height adjustment of footrest 81. Any aperture within a column of regularly spaced apertures 88, through a back wall of upright member 71, can receive bolt 85 spring-urged therein. Slider member 83, and therefore footrest 81, can be vertically adjusted by first pulling and then vertically moving knob 87 to a preferred height level. Releasing knob 87, thereby releasing bolt 85, at an adjacent aperture 88 locks footrest 81 in place.

A user height scale 36C (FIG. 6) printed on member 71 is used in the same manner as described for scale 36A of squat support 10. In this case, the top of slider member 83 can be moved to a selected scale mark.

Squat support 70 also includes a driver 90 for adjusting the height of footrest 81. Driver 90 comprises a hand crank 91 coaxially fixed to a pinion 92 on a rotatably supported shaft. A conventional crank bearing, fastened to member 71 with short screws or welding, supports driver 90. Pinion 92 is drivingly engaged with a plastic molded toothed rack 93 fixed with screws 56 (FIG. 7) to slider member 83. When bolt 85 is unlocked, rack 93 is vertically movable within slot 74 (FIG. 6) so that by rotating crank 91, with crank handle 94, footrest 81 can be vertically adjusted.

Figure 8:
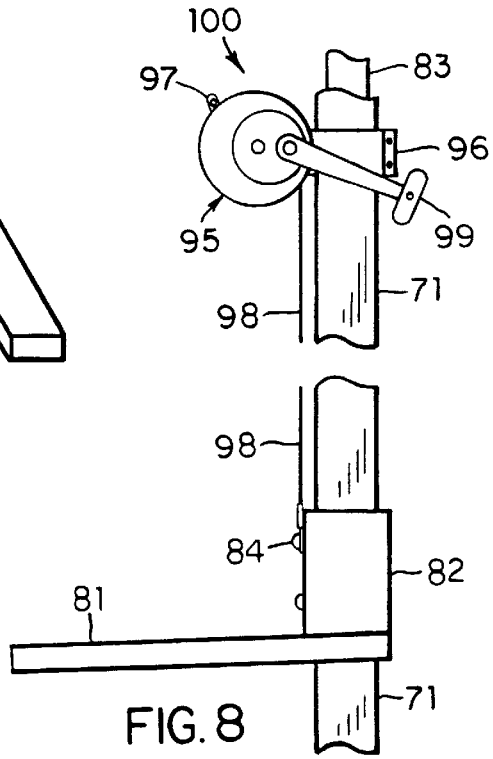
FIG. 8 is a fragmental side view of another preferred portable squat support.

Shown in FIG. 8 is another preferred squat support 100 that is similar to squat support 70 except for the differences described as follows. The locking means, driver 90, and rack 93 of squat support 70 are not included in squat support 100. Instead, a driver comprising a conventional winch 95, of the type having an internal ratchet wheel, is fixedly mounted to upright member 71 by a surrounding mounting clamp 96. Winch 95 includes flexible stranded steel wire or cable 98 wound thereon. A distal end portion of cable 98 is provided with a connector that attaches cable 98 to sleeve 82 using screw 84. Hence, footrest 81 can be raised by rotation of winch crank 99 as cable 98 winds on winch 95. Reverse rotation of crank 99 unwinds cable 98 wherein the weight of footrest 81, and that of slider member 83, lowers footrest 81. The ratchet of winch 95 can be set by a conventional ratchet switch 97 to prevent cable 98 from unwinding. Thus, footrest 81 can be held in place after being adjusted to a preferred height.

Among the common advantages of winch 95, driver 90, driver 47, and driver 61, is that footrest height adjustments can be made while a user's legs are supported on the footrest being adjusted. Winch 95 and drivers 90, 47, and 61, can therefore be used to elevate and lower the legs of users.

Figure 9:
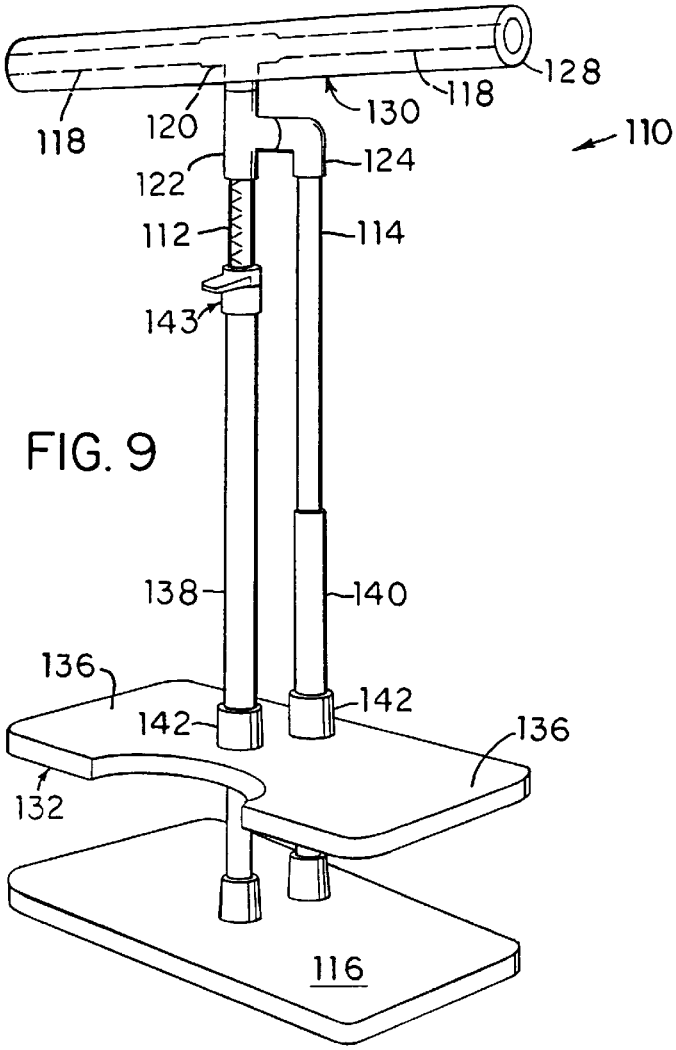
FIG. 9 is a front perspective view of another preferred portable squat support.
Figure 10:
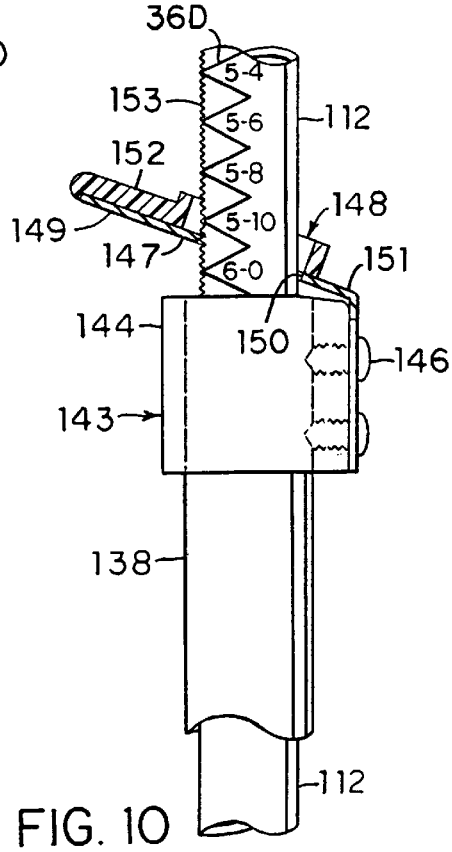
FIG. 10 is an enlarged fragmental side view, partly in section, of an intermediate portion of the squat support of FIG. 9 that includes a self-locking footrest lock.
Figure 11:
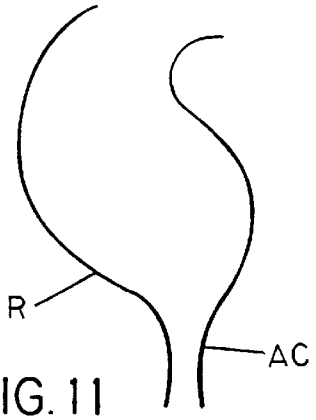
FIG. 11 is a diagrammatic depiction of a human anal canal and rectum of a person in an optimal squat posture.
Figure 12:
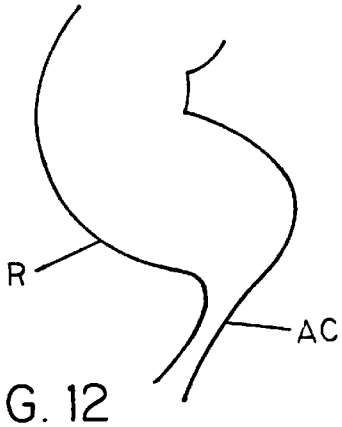
FIG. 12 is a diagrammatic depiction of a human anal canal and rectum of a person in a conventional sitting posture, such as on a toilet without benefit of the present invention.

FIG. 9 shows another preferred portable squat support 110 having a parallel pair of spaced elongate upright members; a first member 112 and a second member 114, each being comprised of a steel tube of circular cross-section. Members 112, 114 are spaced approximately 2.5 inches apart. A rectangular plastic molded base 116 is fixedly connected to lower end portions of upright members 112, 114 for supporting them in an upstanding position, one in front of the other. Each upright member 112, 114 is mounted midway between lateral opposite ends of base 116. The connecting means is similar to that described for connecting bases 14 to members 12 of squat support 10, except that members 112, 114 are mounted on the same base 116.

A metal tube, forming a horizontal member 118, is connected transversely to upper end portions of upright members 112, 114 by T-connectors 120, 122 and an elbow connector 124; all fixed together by conventional means such as soldering or welding. Lateral end portions of member 118 extend in opposite directions laterally of members 112, 114. Each upright member 112, 114 is midway between opposite lateral ends of member 118. An elongate tubular soft foam cushion 128 surrounds the length of member 118. Cushion 128 and member 118 form an elongate horizontal upper body support 130.

An elongate rectangular plastic molded footrest 132 is movably connected to upright members 112, 114 for supporting a user's legs in an elevated bent position. A user's feet normally rest on an upper surface of footrest 132. Lateral end portions 136, of footrest 132, extend in opposite directions laterally of the upright members 112, 114 so that upright members 112, 114 are between the user s feet when resting on footrest 132. Each upright member 112, 114 is midway between opposite lateral ends of footrest 132.

Footrest adjusting means includes a pair of elongate slider members or sliders 138, 140 slidably mounted to upright members 112, 114, respectively. Each slider 138, 140 is a tube surrounding and having a common axis with a respective upright member 112, 114. A lower end portion of each slider 138, 140 is fixedly connected to footrest 132 so that sliders 138, 140 and footrest 132 are vertically movable along upright members 112, 114. The connecting means includes sleeves 142, integrally molded with footrest 132, that receive respective lower end portions of sliders 138, 140 tightly therein. Flared lower ends (not shown) of sliders 138, 140, beneath footrest 132, prevent detachment.

Mounted on an upper end portion of slider 138 is a self-locking footrest lock 143 that includes a plastic sleeve 144 (FIG. 10) surrounding slider 138. A boss on sleeve 144 has threaded bores that receive setscrews 146 that fix lock 143 onto slider 138.

Lock 143 further includes a catch 148 surrounding member 112. Catch 148 comprises a spring-metal plate 147 having an aperture 150 that receives member 112 therein. A spring-hinge 151 connects catch 148 to sleeve 144 and slider 138. Spring-hinge 151 is a downwardly bent extension of plate 147 and has two apertures that receive setscrews 146 to hold catch 148 in place. Catch 148 also includes a thumb-lever 149 that is an extension of plate 147 extending opposite of spring-hinge 151.

Aperture 150 is slightly larger than the diameter of member 112 so that when plate 147 is horizontal, catch 148 makes no contact with member 112. A plastic cover 152, having a larger aperture than aperture 150 and concentric therewith, is mounted on a non-hinge portion of plate 147 by conventional means. Cover 152 serves for user thumb comfort and to add rigidity to the non-hinge portion of plate 147.

A frontal portion of member 112 is indented with a column of small, closely spaced, horizontal linear depressions or grooves to form a toothed surface 153. Spring-hinge 151 is angled to urge catch 148 to an inclined position wherein an inner edge of plate 147 engages and catches onto toothed surface 153, of member 112, to lock footrest 132 in position. But, when a user presses down on thumb-lever 149, catch 148 will move toward a horizontal position thereby disengaging catch 148 so that footrest 132 is unlocked for being height adjusted. The user can therefore disengage catch 148 with the same hand that holds the upper end portion of slider 138 to height-adjust footrest 132. Lock 143 self-locks to lock footrest 132 when the user releases thumb-lever 149.

Like the lock and slider member combinations of other preferred embodiments described herein, slider 138 and lock 143 comprise a footrest height-adjuster. An upper end portion of the height-adjuster is positioned substantially above footrest 132 to serve as a handle for height-adjusting footrest 132. Hence, a user can adjust footrest 132 from a user-convenient position without having to reach down to footrest 132.

A height scale 36D, printed or inscribed on member 112, has marks including numerals representing heights of potential users, wherein slider 138 is movable to each mark. The marks are calibrated or arranged such that a user can move the top of slider 138, or a designated portion thereof, to a mark corresponding to the user's height, thereby adjusting the footrest to a predetermined position that is most advantageous for the user. The user can therefore be supported, by squat support 110, in an optimal squat position.

Though each of the preferred embodiments will benefit the great majority of people, each preferred embodiment also has advantages that can serve people with particular needs. The low cost of squat support 10 will appeal to those with a very limited budget. Stylish people may prefer the aesthetic geometric configuration of support 110. Overweight people will appreciate the lifting assistance of squat support 50 or 70 as the driver lifts their legs up to the squat position. Many disabled people will benefit from squat support 50, 60 or 70 because the driver will lift their legs up to squat posture. For those that need it, the cordless electric driver of squat support 60 will move them into the squat position. The upper body supports of the preferred embodiments provide stability for all users, able and disabled, in addition to the squat-related benefits.

Most of the components of the preferred embodiments are made of metal tubing and molded plastic to reduce cost and weight. They can be packaged disassembled to reduce the size and volume of packaging thereby requiring less shelf space in retail stores.

Ramifications and Scope

Although the above description contains many specificities, these should not be construed as limitations on the scope of the invention, but rather as exemplifications of preferred embodiments. Many other variations are possible. For example, lock 143, of support 110, can replace lock 34 of support 10. Driver 47, 61, or 90 can be adapted to support 110 for drivingly adjusting the footrest. The angle-adjustable footrest of support 10 can be adapted to support 50 wherein the footrest can be pivotally connected to slider members 46 and tube 52.

Other embodiments can be devised without an upper body support. An example is a portable squat support similar to support 110, but without upper body support 130. Another example is a portable squat support similar to support 70, but without upper body support 80 and without braces 78. Thus, the scope of the invention should be determined not by the given examples, but by the appended claims and their legal equivalents.

What is claimed is:

1. A portable device for supporting a user in an advantaged posture to facilitate defecation while on a conventional toilet fixture, the device comprising:

an elongate horizontally positioned upper body support;

upright means for supporting the body support adjacent the user's abdomen and at approximately the same level thereof so that the user's upper body is supported on the body support; and a footrest connected to the upright means and positioned below the body support for supporting the user's legs in an elevated bent position the footrest being movably supported on the upright means; and an elongate upstanding footrest height-adjuster having upper and lower end portions, the lower end portion being connected to the footrest, the upper end portion being positioned substantially above the footrest for vertically adjusting the footrest from a position higher than the footrest.

2. The device as defined in claim 1, further comprising upper body support adjusting means for adjusting the height of the upper body support.

3. The device as defined in claim 1, further comprising a height scale displayed thereon, the scale having marks that represent heights of potential users, the marks being arranged cooperatively with the height-adjusting means for guiding the user to vertically adjust the footrest to a predetermined position that is particularly advantageous for facilitating defecation according to the user's height.

4. The device as defined in claim 1, wherein said footrest hight-adjuster includes a hand crank drivingly connected to the footrest, for adjusting the height of the footrest by rotating the crank.

5. The device as defined in claim 1, wherein the upright means comprises an elongate upright member having upper and lower end portions, the body support being connected to the upper end portion, and a base connected to the lower end portion for supporting the member upstanding.

6. The device as defined in claim 5, wherein the footrest includes opposite lateral ends and upright member being approximately midway between the lateral ends of the footrest.

7. The device in claim 5, wherein the upper body support includes opposite lateral ends and the upright member being approximately midway between the lateral ends of the upper body support.

8. The device as defined in claim 5, further comprising a second elongate upright member wherein the upright members are positioned on in front of the other such that each upright member is approximately midway between opposite lateral ends of the footrest.

9. The device as defined in claim 1, wherein the upper body support is positioned forward of the upright means so that the upper body support is closer to the user than the upright means.

10. The device as defined in claim 1, wherein the footrest is elongate and parallel to the upper body support.

11. A portable device for supporting a user in an advantaged position to facilitate defecation while on a toilet, the device comprising:

a footrest for supporting the user's legs in an elevated bent position;

an upright member supporting the footrest such that the footrest is vertically movable;

an elongate upright footrest height-adjuster having upper and lower end portions, the lower end portion being connected to the footrest, the upper end portion being positioned substantially above the footrest for the convenience of the user to vertically adjust the footrest from a position higher than the footrest, and an upper body support held above the height-adjuster by said upright member for supporting the upper body of the user wherein the height-adjuster is vertically movable relative to the upper body support.

12. The device as defined in claim 11, further comprising a height scale displayed on the device, the scale having marks representing heights of potential users, the marks being arranged such that a designated portion of the device is movable to each mark selectively such that when moved to a mark corresponding to the user's height the footrest is thereby adjusted to a predetermined position that is particularly advantageous for facilitating defecation.

13. The device as defined in claim 11, wherein the device includes a lock having a catch hinge-connected to the height-adjuster for locking the footrest at selective heights.

14. The device as defined in claim 11, wherein the footrest is slidably supported for moving in a straight and substantially vertical path.

15. The device as defined in claim 11, wherein said upright member is elongate and parallel to the height-adjuster.

16. The device as defined in claim 11, wherein said upper member is elongate and height-adjuster includes an elongate upstanding slider member extending substantially above the footrest, the slider member and said upright member having a common longitudinal axis.

17. A device for supporting a user in an advantaged position to facilitate defecation while on a toilet, the device comprising:

a footrest for supporting the user's legs in an elevated bent position;

footrest height-adjusting means for vertically adjusting the footrest; and a height scale displayed on the device, the scale having marks that represent heights of potential users, the marks being arranged cooperatively with the height-adjusting means for guiding the user to vertically adjust the footrest to a predetermined position that is particularly advantageous for facilitating defecation according to the user's height.

18. The device as defined in claim 17, wherein the scale marks are arranged such that a designated portion of the footrest height-adjusting means is movable to each mark selectively such that when moved to a mark corresponding to the user's height the footrest is thereby adjusted to the predetermined position.

* * * * *